United States Patent [19]

Childs

[11] 3,983,015

[45] Sept. 28, 1976

[54] ELECTROCHEMICAL FLUORINATION USING EXCESS CURRENT

[75] Inventor: William V. Childs, Bartlesville, Okla.

[73] Assignee: Phillips Petroleum Company, Bartlesville, Okla.

[22] Filed: June 23, 1975

[21] Appl. No.: 589,632

[52] U.S. Cl. ..... 204/59 F
[51] Int. Cl.[2] ..... C25B 3/08
[58] Field of Search ..... 204/59 F

[56] References Cited

UNITED STATES PATENTS

| | | | |
|---|---|---|---|
| 2,519,983 | 8/1950 | Simons | 204/62 |
| 3,298,940 | 1/1967 | Ashley et al. | 204/62 |
| 3,511,760 | 5/1970 | Fox et al. | 204/59 F |

*Primary Examiner*—R. L. Andrews

[57] ABSTRACT

An electrochemical fluorination process is carried out in a system utilizing a porous carbon anode wherein there is contact, within the pores of the anode, between an essentially anhydrous liquid hydrogen fluoride electrolyte and a fluorinatable feedstock. An excess of current is utilized over what would be theoretically required to replace the hydrogen equivalents in the feedstock with fluorine atoms resulting from the controlled electrolytic evolution of fluorine.

8 Claims, No Drawings

ELECTROCHEMICAL FLUORINATION USING EXCESS CURRENT

BACKGROUND OF THE INVENTION

This invention relates to electrochemical fluorination using a porous carbon anode.

It has long been known to produce partially or totally fluorinated products from both organic and inorganic feedstocks by means of an electrochemical process wherein fluorine electrolytically generated from an HF-containing electrolyte replaces hydrogen equivalents in the feedstock. In such processes of the prior art it has been considered essential to utilize at least a slight excess of fluorinatable feedstock, with respect to electrical current, so as to avoid the evolution of free fluorine. Indeed, most electrochemical fluorination processes have been carried out with a several-fold excess of fluorinatable feedstock with respect to electrical current.

SUMMARY OF THE INVENTION

It is an object of this invention to achieve higher yields of perfluorinated products in an electrochemical fluorination process;

it is a further object of this invention to provide smoother cell operation in an electrochemical fluorination process;

it is yet a further object of this invention to reduce carbon chain scission type by-products in an electrochemical fluorination process; and it is still yet a further object of this invention to provide an improved process for producing valuable fluorinated products.

In accordance with this invention, fluorinatable feedstock is continuously contacted with essentially anhydrous hydrogen fluoride electrolyte in the pores of a porous carbon anode, the feedstock being supplied at a rate such that the hydrogen equivalents contained therein amount to less than that which theoretically should react with the amount of fluorine being generated at a given electrical current rate.

DESCRIPTION OF THE PREFERRED EMBODIMENT

In the electrochemical fluorination process of this invention, a fluorinatable feedstock is continuously supplied to an HF-containing electrochemical fluorination cell via a porous carbon anode under conditions which generate fluorine at a rate in excess of that required to completely fluorinate the feedstock. The basic electrochemical fluorination process employing reaction within the pores of the anode, over which basic process the instant invention is an improvement, is disclosed in Fox et al U.S. Pat. No. 3,511,760 and Ashe, Jr. et al. U.S. Pat. No. 3,711,396, the disclosures of which are hereby incorporated by reference. Higher single pass yields of perfluorinated products are obtained, in accordance with the invention, particularly with relatively heavy feedstocks, with suprisingly smooth cell operation and low yields of carbon chain scission type by-products such as carbon tetrafluoride. Excess fluorine formed in the process reacts with hydrogen generated at the cathode in the undivided cell to regenerate hydrogen fluoride. Thus, excess fluorine equivalents are not lost but remain in utilizable form within the system.

One of the advantages of the present invention is that the electrochemical fluorination of relatively high molecular weight fluorinatable feedstocks can be carried out with greater convenience. Such feedstocks frequently require special conditions such as relatively high temperatures, or the use of carrier gases, or relatively short runs interspersed with operation of the anode with relatively light and more easily fluorinated feeds such as ethane. One of the reasons for this is that the small amounts of dimers or other heavy products which are frequently found under fluorination conditions tend to accumulate in the anode thus disrupting the normal feed flow, causing frequent anode polarization, excessive fragmentation, etc.

Unexpectedly, operating under the conditions of the present invention has resulted in smoother, more stable operation with relatively heavier feedstocks for longer periods of time than had been experienced earlier. Moreover, such improved operation was obtained without the disastrous results predicted in the prior art as being brought about by the accumulation of pockets of unreacted elemental fluorine. On the contrary, it has been found that the excess fluorine reacts smoothly with the cathodic hydrogen apparently at or within the immediate vicinity of the anode.

Still another advantage of the present process is that it facilitates the production of perfluorinated products. That is, greater per-pass conversions are obtained, and the products of the cell can be substantially free of unreacted feedstocks and only partially fluorinated materials. Thus, isolation and purification of the desired product from the crude cell product can be significantly simplified.

In an electrochemical process, two Faradays are required to convert one

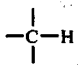

group to a

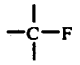

group. Since the passage of 26.8 amperes of current for 1 hour results in the transfer of one Faraday, two Faradays would be transferred by the passage of 53.6 amperes of current in an hour's time. Thus, an ethane feedstock in a conventional electrochemical fluorination process operating at 53.6 amperes per hour must be fed to the cell at a rate of not less than one-sixth mol/hour so that, in accordance with the teaching of the prior art, the hydrogen equivalents in the feedstock just equal or exceed the equivalents of fluorine generated electrolytically. The following equations are illustrative for ethane feedstock:

$$2HF \xrightarrow{\text{2 Faradays}} H_2\ (\text{cathode}) + F_2\ (\text{anode}) \qquad \text{(a)}$$

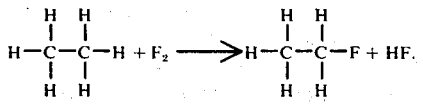

(b)

Conversely, the present invention teaches that in an electrochemical fluorination process utilizing ethane feedstock and a current of 53.6 amperes per hour, the ethane feed is supplied to the cell at less than one-sixth mol/hour (ethane contains 6 replaceable hydrogens/-mol) so that the hydrogen equivalents supplied to the cell in an hour are less than the equivalents of fluorine generated electrolytically in that same time period. By a similar analysis, the lower feedstock rate for fluoroform ($CHF_3$) in the inventive process would be less than one mol per hour with an operating current of 53.6 amperes per hour.

Any undivided cells suitable for continuous electrochemical fluorination can be used in the present invention. Cells which are particularly applicable are described in MacMullin et at. U.S. Pat. No. 3,692,660, the disclosure of which is hereby incorporated by reference.

Any porous carbon anodes which provide for the introduction of the fluorinatable feedstock to the bottom of said anodes are useful in the process of the present invention. Particularly suitable porous carbon anodes are shown in said U.S. Pat. No. 3,711,396.

The anodes comprise porous carbon having a relatively uniform pore size. The average pore diameter will generally be in the range of 1 to 150 microns, preferably between 40 and 140, and still more preferably between 50 and 120 microns. These values depend somewhat on the depth of immersion of the electrode with deeper immersions requiring somewhat smaller pores. Generally, the permeability of such porous materials will be in the range of 0.5 to 75 darcys, preferably from about 5 to about 75, and still more preferably from about 10 to about 70 darcys. In general, the total porosity will be in the range of about 15 to about 60 percent. The bottom of the cylindrical porous carbon anode is provided with a cavity into which gaseous or vaporous feed materials are introduced for an electrochemical conversion process in which the reaction takes place within the confines of the porous anode.

In operation, the feed is generally discharged into a cavity in the bottom of the anode as a gas or liquid where it is absorbed into the porous electrode element. It is to be noted that the temperature of the electrode may be substantially higher than that of the electrolyte. While it is not desired to limit the invention to any theory of operation, it is believed that the electrolyte partially penetrates the electrode through some of the larger pores. The feed material distributes itself throughout the porous electrode and migrates to near the outer surface to form a three-phase boundary of feed, electrolyte, and electrode element, at which point the reaction takes place. The product and unreacted feed, if any, then migrate up to the portion of the electrode element above the electrolyte level where they are collected, without ever having broken out into the bulk of the electrolyte. In some instances, the feed can momentarily be in contact with the bulk of the electrolyte when it is introduced into the cavity.

A current collector such as a copper bar can be fitted into the top of the porous carbon anode. Said current collector can be disposed in a hole drilled to accommodate the metal bar in the top of the porous carbon anode.

The electrochemical fluorination process is carried out in a medium of hydrogen fluoride electrolyte. Although said hydrogen fluoride electrolyte can contain small amounts of water, such as up to about 5 weight percent, it is preferred that said electrolyte be essentially anhydrous. The hydrogen fluoride electrolyte is consumed in the reaction and must be either continuously or intermittently replaced in the cell.

Pure anhydrous liquid hydrogen fluoride is nonconductive. The essentially anhydrous liquid hydrogen fluoride described above has a low conductivity which, generally speaking, is lower than desired for practical operation. To provide adequate conductivity in the electrolyte, and to reduce to hydrogen fluoride vapor pressure at cell operating conditions, an inorganic additive can be incorporated in the electrolyte. Examples of suitable additives are inorganic compounds which are soluble in liquid hydrogen fluoride and provide effective electrolytic conductivity. The presently preferred additives are the alkali metal (sodium, potassium, lithium, rubidium, and cesium) fluorides and ammonium fluoride. Other additives which can be employed are sulfuric acid and phosphoric acid. Potassium fluoride, cesium fluoride, and rubidium fluoride are the presently preferred additives. Potassium fluoride is the presently most preferred additive. Said additives can be utilized in any suitable molar ratio of additive to hydrogen fluoride within the range of from 1:4.5 to 1:1, preferably 1:4 to 1:2. The presently most preferred electrolytes are those which correspond approximately to the formulas KF.2HF, KF.3HF, or KF.4HF. Such electrolytes can be conveniently prepared by adding the required quantity of hydrogen fluoride to KF.HF (potassium bifluoride). In general, said additives are not consumed in the process and can be used indefinitely. Said additives are frequently referred to as conductivity additives for convenience.

The electrochemical fluorination can be effectively and conveniently carried out over a broad range of temperatures and pressures limited only by the freezing point and the vapor pressure of the electrolyte. Generally speaking, the fluorination process can be carried out at temperatures within the range of from −80° to 500°C, at which the vapor pressure of the electrolyte is not excessive, e.g., less than 250 mm Hg. It is preferred to operate at temperatures such that the vapor pressure of the electrolyte is less than about 50 mm Hg. As will be understood by those skilled in the art, the vapor pressure of the electrolyte at a given temperature will be dependent upon the composition of said electrolyte. It is well known that additives such as potassium fluoride cause the vapor pressure of liquid hydrogen fluoride to be decreased an unusually great amount. A presently preferred range of temperature is from about 60° to about 105°C. Higher temperatures sometimes tend to promote fragmentation of the product molecules.

Pressures substantially above or below atmospheric can be employed if desired, depending upon the vapor pressure of the electrolyte as discussed above. In all instances, the cell pressure will be sufficient to maintain the electrolyte in liquid phase. Generally speaking, the process is conveniently carried out at substantially atmospheric pressure. It should be pointed out that a valuable feature of the process is that the operating conditions of temperature and pressure within the limitations discussed above are not critical and are essentially independent of the type of feed employed in the process.

For purposes of efficiency and economy, the rate of direct current flow through the cell is maintained at a rate which will give the highest practical current densities for the electrodes employed. Generally speaking, the current density will be high enough so that anodes of moderate size can be employed, yet low enough so that the anode is not excessively corroded or disintegrated under the given current flow. Current densities within the range of from 30 to 1000, or more, preferably 50 to 500, milliamperes per square centimeter of anode geometric surface area can be used. Current densities less than 30 milliamperes per square centimeter of anode geometric surface are not practical because the rate of fluorination is too slow. The voltage which is employed will vary depending upon the particular cell configuration employed and the current density employed. Voltages in the range of from 4 to 12 volts are typical. The maximum voltage will not exceed 20 volts per unit cell. Thus, as a guide, voltages in the range of 4 to 20 volts per unit cell can be used.

In the present inventive process, it is necessary that the feedstock be introduced at a rate such that the number of C — H equivalents is less than the number of fluorine equivalents generated electrolytically. As indicated above, the passage of two Faradays of charge (53.6 amperes of current for 1 hour) results in the conversion of one equivalent of C — H bonds to one equivalent of C — F bonds. Therefore, in the present inventive process, the number of feedstock hydrogen equivalents introduced into the anode per hour is less than one-half the number of Faradays passed through the anode per hour. Feed rates in the range of 0.1 to 0.99 feedstock hydrogen equivalent per hour for 53.6 amperes of current are suitable for use in the present invention. A preferred range of feed rates is 0.2 to 0.75 feedstock hydrogen equivalents per hour for 53.6 amperes of current.

With feeds containing olefinic and/or acetylenic unsaturation wherein fluorine addition as well as fluorine substitution of hydrogen atoms takes place, the theoretical amount of current is, of course, computed to include two Faradays per double (olefinic) bond and four Faradays per triple (acetylenic) bond. Thus, for simplicity in calculating the theoretical amount of current (hence fluorine) required to completely fluorinate a given feedstock, each double bond is considered to correspond to one hydrogen (C — H bond) equivalent and each triple bond is considered to correspond to two hydrogen (C — H bond) equivalents. Similarly, a feed such as CO which also adds fluorine can be considered to contain the equivalent of a double bond and thus corresponds to one hydrogen (C — H bond) equivalent.

Under the conditions of excess current, hence excess fluorine, the electrochemical fluorination cell and porous anode will, of course, operate under conditions of greater severity. Depending upon the geometry of the cell, the design of the anode, and particularly on the ability of the system to dissipate the heats of reaction involved, the operating life of a given porous carbon anode can be significantly shorter and some anodes will require more frequent replacement.

Very few organic compounds are resistant to fluorination. Consequently, a wide variety of feed materials, both normally liquid and normally gaseous compounds, can be used as feedstocks in this process.

Generally speaking, desirable organic starting materials which can be used are those containing from 2 to 12, preferably 2 to 10, carbon atoms per molecule. However, reactants which contain less than 2 or more than 12 carbon atoms can also be used. Some general types of organic starting materials which can be used include, among others, the following: alkanes, alkenes, alkynes, amines, ethers, esters, acid halides, ketones, mercaptans, nitriles, alcohols, aromatic compounds, and partially halogenated compounds. It will be understood that the above-named types of compounds can be either straight chain, branched chain, or cyclic compounds.

Organic compounds which are normally gaseous or which can be introduced in gaseous state into the pores of a porous anode under the conditions employed in the electrolysis cell, and which are capable of reacting with fluorine, are presently preferred as starting materials in the practice of the invention to produce fluorine-containing compounds. However, it is within the scope of the invention to utilize starting materials which are introduced into the pores of the anode in liquid state.

If desired, suitable feed materials having boiling points above cell operating temperatures can be passed into the pores of the porous anode in gaseous state by utilizing a suitable carrier gas. Thus, a suitable carrier gas can be saturated with the feed reactant (as by bubbling said carrier gas through the liquid reactant), and then passing the saturated carrier gas into the pores of the porous anode. Suitable carrier gases include the inert gases such as helium, xenon, argon, neon, or krypton. Nitrogen is a particularly suitable carrier gas. It is also within the scope of the invention to utilize normally gaseous materials such as hydrocarbons containing from 1 to 4 carbon atoms as carrier gases. These latter gases will react, but in many instances this will not be objectionable. It is also within the scope of the invention to utilize the above-described carrier gases, and particularly said inert gases, as diluents for the feedstocks which are normally gaseous at cell operating conditions.

Since fluorine is so reactive, no list of practical length could include all starting materials which can be used in the practice of our invention. However, representative examples of the above-described starting materials include, among others, the following: methane; ethane; propane; butane; isobutane; pentane; n-hexane; n-octane; cyclopropane; cyclopentane; cyclohexane; cyclooctane; 1,2-dichloroethane; 1-fluoro-2-chloro-3-methylheptane; ethylene; propylene; cyclobutene; cyclohexene; 2-methylpentene-1; 2,3-dimethylhexene-2; butadiene; vinyl chloride; 3-fluoropropylene; acetylene; methylacetylene; vinyl acetylene; 3,3-dimethylpentyne-1; allyl chloride; methylamine; ethylamine; diethylamine; 2-amino-3-ethylpentane; 3-bromopropylamine; triethylamine; dimethyl ether; diethyl ether; methyl ethyl ether; methyl vinyl ether; 2-iodoethyl methyl ether; di-n-propyl ether; methyl formate; methyl acetate; ethyl butyrate; ethyl formate; n-amyl acetate; ethyl caprate; methyl 2-chloroacetate; hexyl trifluoroacetate; carbon monoxide; hexanoyl fluoride; acetone; 2-butanone; methyl mercaptan; ethyl 2-methyl-3-mercaptoheptane; acetonitrile; propionitrile; n-butyronitrile; acrylonitrile; n-hexanonitrile; methanol; ethanol; isopropanol; n-hexanol; 2,2-dimethylhexanol- 3; n-butanol; ethylenebromohydrin; benzene; toluene; cumene; o-xylene; p-xylene; and monochlorobenzene.

In the following specific examples, the invention was demonstrated using several different feedstocks. The cell used in these demonstrations was generally described in said U.S. Pat. No. 3,692,660 except that a cell comprising single tube containing an anode (as described in more detail hereinbelow) and a single empty downcomer tube was used instead of a cell using a plurality of such empty and filled tubes. The two tubes were positioned vertically and were connected by horizontal tubular means at the bottoms and at about the midpoints, thus providing a circulating path or loop. The anode was a porous carbon anode and was suspended in one of the vertical tubes, which tube itself was the cathode. The anode was solid as opposed to being a fitted composite of two sections as shown in said U.S. Pat. No. 3,692,660 patent. In operation, the heat generated by the electrolysis and the hydrogen gas formed at the cathode produced a desired amount of circulation in the loop. Excess heat was removed from the cell by means of cooling water which circulated through jackets on the vertical tubes.

The porous carbon anode which was suspended in one of the vertical tubes (the cathode) was constructed from a block of porous carbon having an average pore diameter of 0.089 mm, an average porosity of 46 percent and an average permeability of 18 darcys. The cylindrical anode, fashioned as shown in said U.S. Pat. No. 3,711,396, FIG. 13, was 35.6 cm long and 3.5 cm in diameter with a solid copper current collector extending 12.7 cm into the top of the anode. A polytetrafluoroethylene feed tube, extending along the outside of the anode, penetrated the anode wall to communicate with the small cavity at the bottom face of the cylindrical anode.

EXAMPLE 1

The n-hexyl trifluoroacetate feedstock used in this invention run was prepared from n-hexyl alcohol and trifluoroacetyl fluoride (formula weight 198; 15.1 g/hydrogen equivalent). The electrochemical fluorination was carried out in the cell and anode described above containing a molten electrolyte of KF.2HF. The n-hexyl trifluoroacetate was pumped into the cell at the approximate average rate of about 14 g/hr (ca. 0.07 mol/hr or ca. 0.9 hydrogen equivalent/hr) over a period of 6.5 hours. During this time period, a current of 80.4 amperes was used corresponding to the passage of 3 Faradays per hour whereas 1.8 Faradays per hour in theory would have been sufficient charge to electrochemically fluorinate 0.9 feedstock hydrogen equivalent per hour. Thus, sufficient charge was used for about 166% conversion of the feedstock hydrogen equivalents pumped to the anode per hour in accordance with the present invention. A two-phase cell effluent amounting to 184 g was collected. The more dense phase was separated and combined with the more dense phase of a similar run. This combined sample was distilled to give a sample for characterization. The major component of this sample (~70%) was shown to be the desired perfluorohexanoyl fluoride by infrared, nuclear magnetic resonance, and mass spectral analyses.

The run was characterized by smoother and more stable operation compared to that expected when using a feedstock of this relatively high molecular weight. The anode of this run was found to be operable for a total of about 14 hours under these conditions of ultraconversion before it failed due to cracking at the electrolyte level and had to be replaced by a fresh anode.

EXAMPLE II

The n-octyl trifluoroacetate feedstock used in this inventive run was prepared from n-octyl alcohol and trifluoroacetyl fluoride (formula weight 226; 13.3 g/hydrogen equivalent). The electrochemical fluorination was carried out in the same apparatus and in essentially the same manner as described in Example I. A current of 80.6 amperes was used which corresponds to the passage of 3 Faradays of charge per hour. The n-octyl trifluoroacetate was fed at the approximate average rate of 13–14 g/hr (ca. 1.0 feedstock hydrogen equivalent per hr.) for a period of approximately 4 hours at a cell operating temperature of 240°F (115.5°C). Thus, sufficient charge was used for about 150% conversion of the feedstock hydrogen equivalents fed to the anode per hour in accordance with the present invention. A two-phase cell effluent of 86 g was collected.

During the 4-hour run, the fluorination proceeded surprisingly smoothly and in a much more stable manner than when converting feedstocks of this molecular weight under an electrical current sufficient for only about 30 percent conversion. The anode of this run was found to operate for a total of about 5.5 hours before it developed a groove at the electrolyte level and was replaced.

EXAMPLE III

The electrochemical fluorination of carbon monoxide was carried out in essentially the same manner as that described, respectively, for n-hexyltrifluoroacetate and n-octyltrifluoroacetate in Examples I and II. The feed rate of carbon monoxide was approximately 0.80 mol/hr over a reaction period of 8¼ hours. (The temperature was about 193°F for 5¼ hours and then increased to 230°F for the last 3 hours.) A current of 53.6 amperes was employed corresponding to the passage of 2 Faradays of charge per hour which represented about 125% conversion of the feedstock hydrogen equivalents fed to the anode per hour. The cell effluent containing the desired carbonyl fluoride weighed 240 grams. The run carried out at these conditions of excess fluorine was suprisingly smooth and stable.

While this invention has been described in detail for the purpose of illustration, it is not to be construed as limited thereby but is intended to cover all changes and modifications within the spirit and scope thereof.

I claim:

1. In a process for the electrochemical fluorination of a fluorinatable feedstock comprising:

passing an electric current through a current-conducting essentially anhydrous liquid hydrogen fluoride electrolyte contained in an electrolysis cell provided with a cathode and porous carbon anode;

contacting said feedstock with said electrolyte within pores of said anode to thus at least partially fluorinate at least a portion of said feedstock;

and recovering fluorinated product and unreacted feedstock from said anode;

the improvement comprising introducing said feedstock at a rate within the range of 0.2 to 0.75 feedstock hydrogen equivalents per hour per 53.6 amperes of current.

2. A method according to claim 1 wherein a current density of 30 to 1,000 milliamps/cm$^2$ of anode geometric surface and a voltage within the range of 24 to 20 volts are utilized.

3. A method according to claim 2 wherein said feedstock is selected from n-hexyltrifluoroacetate, octyltrifluoroacetate, and carbon monoxide.

4. A method according to claim 3 wherein said electrolyte comprises KF.2HF.

5. A method according to claim 1 wherein a current density of 30 to 1,000 milliamps/cm$^2$ anode geometric surface, and a voltage of 4 to 20 volts are utilized.

6. A method according to claim 1 wherein said feedstock is selected from a group consisting of n-hexyltrifluoroacetate, and octyltrifluoroacetate, and carbon monoxide.

7. A method according to claim 1 wherein said electrolyte comprises KF.2HF.

8. A method according to claim 1 wherein said contacting is carried out at a temperature within the range 60°to 105°C.

* * * * *